United States Patent [19]

Knippel

[11] 4,280,778

[45] Jul. 28, 1981

[54] HOPPER CAR DOOR OPERATING MECHANISM

[75] Inventor: Willis H. Knippel, Palos Park, Ill.

[73] Assignee: Pullman Incorporated, Chicago, Ill.

[21] Appl. No.: 37,569

[22] Filed: May 9, 1979

[51] Int. Cl.[3] ..... B65G 67/00

[52] U.S. Cl. ..... 414/387; 105/241.1

[58] Field of Search ..... 414/387, 388; 105/241.1, 241.2; 246/246, 313, 365, 367, 200

[56] References Cited

U.S. PATENT DOCUMENTS

| | | | |
|---|---|---|---|
| 2,616,576 | 11/1952 | Sanford et al. | 414/387 |
| 2,634,007 | 4/1953 | Sanford | 414/387 |
| 3,321,093 | 5/1967 | Arbel | 414/387 |
| 3,452,886 | 7/1969 | Dorey | 414/388 |

FOREIGN PATENT DOCUMENTS

| | | | |
|---|---|---|---|
| 598320 | 2/1948 | United Kingdom | 414/388 |

*Primary Examiner*—Robert B. Reeves
*Assistant Examiner*—L. E. Williams
*Attorney, Agent, or Firm*—Richard J. Myers

[57] ABSTRACT

A railway hopper car includes laterally positioned bottom dump discharge openings and doors which are locked in a closed position by a latching mechanism actuated from a ground-mounted trip lever. After the car has been dumped it is moved adjacent to a ground-mounted cam which is engaged by cam followers on the doors thereby swinging the doors again to the closed position.

12 Claims, 6 Drawing Figures

HOPPER CAR DOOR OPERATING MECHANISM

BACKGROUND OF THE INVENTION

1. Field of the Invention

The present invention relates to railway hopper cars. More specifically it relates to door opening and closing mechanisms for the bottom dump doors of the car.

2. Description of the Prior Art

Pertinent patents of the prior art include U.S. Pat. Nos. 1,594,863 Aug. 3, 1926; 1,781,259 Nov. 11, 1930; 3,321,093 May 23, 1967; 3,452,886 July 1, 1969; 2,616,576 Nov. 4, 1952. U.S. Pat. No. 1,594,863 to Warner discloses a longitudinal bottom dump car with gate structures opened by rollers. U.S. Pat. No. 1,781,259 to Welsh et. al. discloses discharge mechanism for cars or tubs for hauling coal in coal mines, the tubs are interconnected for discharge. The patent to Arbel, U.S. Pat. No. 3,321,093 discloses a latching arrangement for hopper car doors as does the patent to Dorey, U.S. Pat. No. 3,452,886. Sanford's et. al. U.S. Pat. No. 2,616,576, discloses electric switches which, when simultaneously activated, act to unlock hopper car doors. The present construction is an improvement over the aforementioned patents, in that it discloses vertically reciprocally mounted plungers connected to the hopper structure by tubular guides. The plungers are actuated from ground-mounted camming arrangements in turn actuating door latches to an open position. This is not disclosed in the aforementioned prior art patents.

SUMMARY OF THE INVENTION

The hopper car of the present invention is ideally suited for the bottom and side discharge of coal from hoppers positioned on opposite sides of the center sill of the car. The doors are positioned to swing downwardly and outwardly with the coal or other materials sliding downward by gravity on a pair of diverging slope sheets whereupon the material is dumped to one side and downwardly of the car to a suitable bin or pit disposed beneath a trestle on which the railroad car is moved. In the present invention each of the laterally spaced doors is opened by a suitable actuating mechanism comprising a vertically reciprocable plunger which is supported by means of a bracket carried by the hopper structure. The plunger is provided at its lower end with a cam follower and is connected at its upper end to suitable linkage means in turn pivotably connected to a bell crank shaped locking lever having a keeper engaging hook portion adapted to engage a keeper element supported on and projecting diagonally upwardly from the car door. A spring mechanism normally urges the bell crank lever to the closed position and exerts a downward force on the plunger.

A ground mounted tripping lever is actuated by the wheel of the car to pivot and engage the cam follower on the plunger thereby moving the same upwardly and thereby disengaging the hook-shaped keeper engaging member from the keeper whereupon the door is swung outwardly and downwardly to an open position by the weight of the material carried within the car. After the hoppers have been discharged the car moves along the track whereupon the cam followers on the outer surfaces of the door engage a trackside closing cam which in turn then swings the doors again to their closed and locked position as the keeper elements on the door are again engaged by the keeper engaging portions of the latch member.

DESCRIPTION OF THE PREFERRED EMBODIMENT

Figure 1:
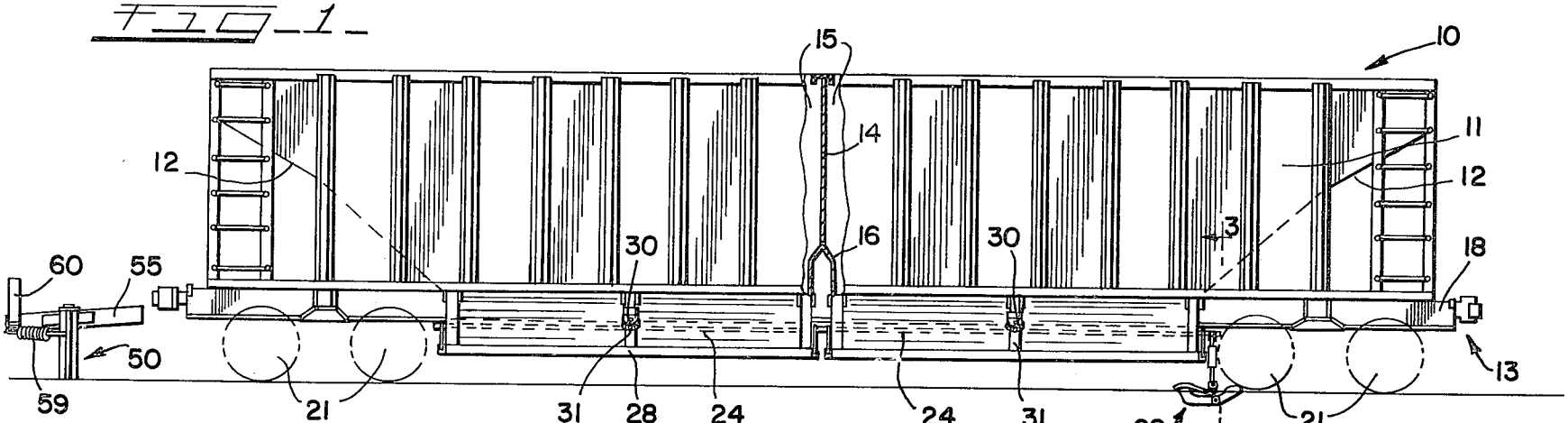
FIG. 1 is a side elevational view of a railway hopper car disclosing ground-mounted camming mechanisms for opening and closing the discharge doors of the car.
Figure 3:
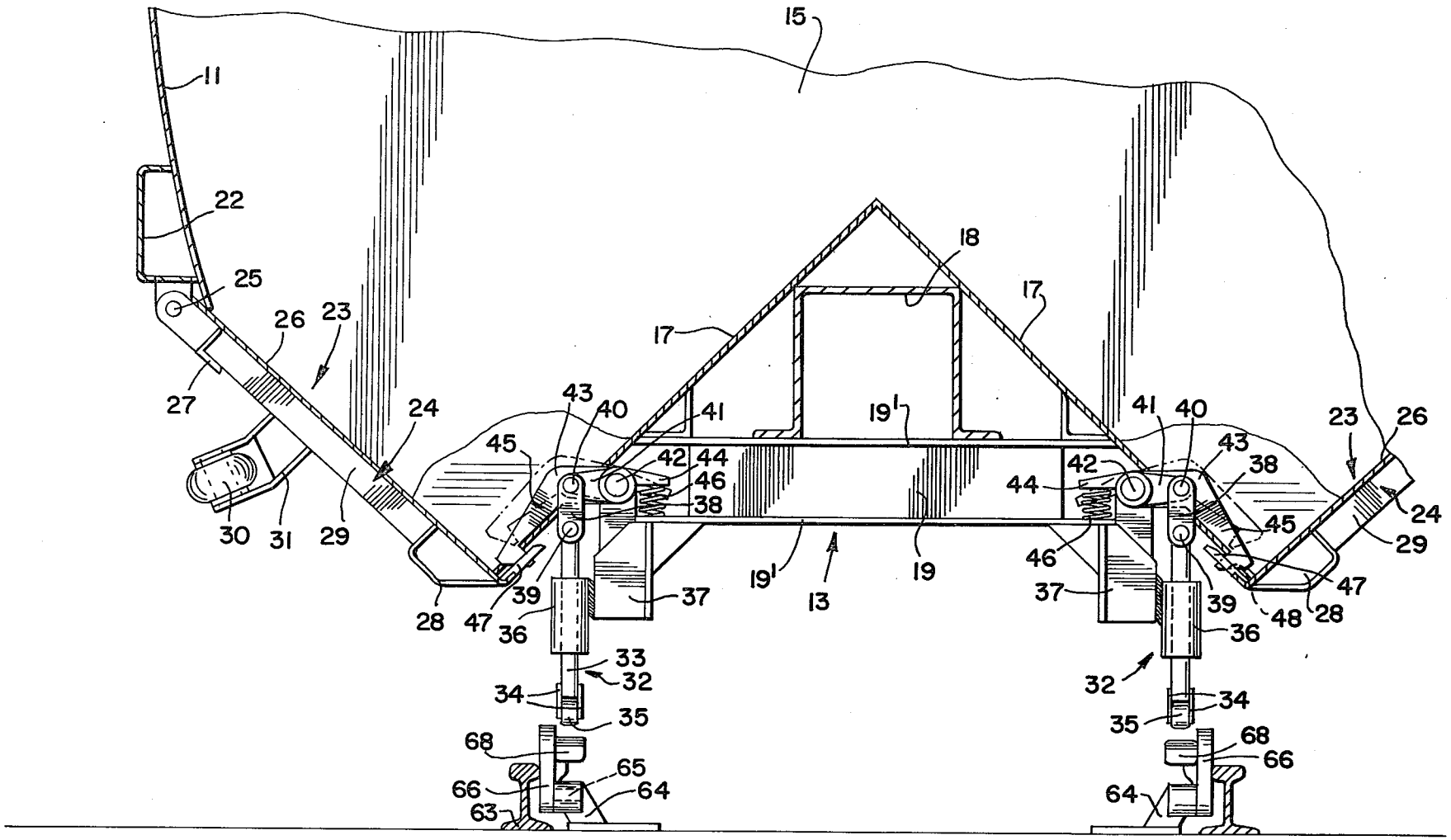
FIG. 3 is a cross-sectional view taken substantially along the line 3—3 of FIG. 1.

FIG. 1 discloses a railway hopper car 10 including side walls 11 and end walls 12 supported on a car underframe 13. The railway car 10 also is divided into longitudinally and laterally spaced hoppers by means of a transverse divider wall 14, as best shown in FIG. 1. As shown in FIG. 3 hoppers 15 are disposed on opposite sides of the center line of the car. The divider wall 14 is also supported on a divider housing 16 separating the longitudinally spaced hoppers of the car.

Figure 6:
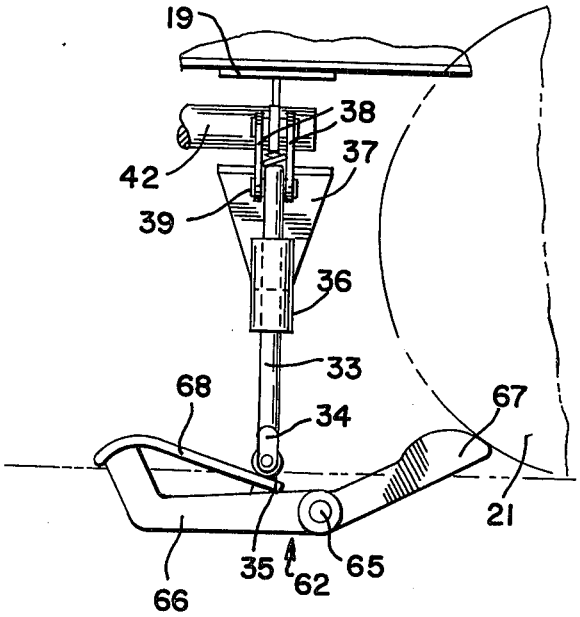
FIG. 6 is a side elevational view of a ground-mounted wheel actuated tripping mechanism.

The hoppers 15 include downwardly and outwardly sloping walls 17 which are suitably supported on a longitudinally extending center sill 18. The underframe 13 also includes a plurality of cross bearers or supports 19 having as best shown in FIGS. 3 and 6 upper and lower horizontal flanges 19'. The railway car 10 and hoppers 15 also include at opposite ends end slope sheets 20. The car underframe 13 is supported on conventional wheel trucks 21 and the car body further includes laterally spaced longitudinally extending side sills 22 of relatively channel shaped construction.

Each of the four hoppers described above includes lower side discharge openings 23 which are controlled by means of doors 24 hingedly connected by hinge bracket and hinge means 25 to the side sills 22. Each of the doors 24 includes an upper longitudinal panel 26 supported on outer longitudinal angles 27 and lower box type longitudinal members 28. Stiffners 29 are provided intermediate and at the opposite ends of the doors 24. As best shown in FIG. 3 each of the doors also includes a roller 30 suitably mounted on roller brackets 31 connected to the outer surfaces of the door 24.

Figure 2:
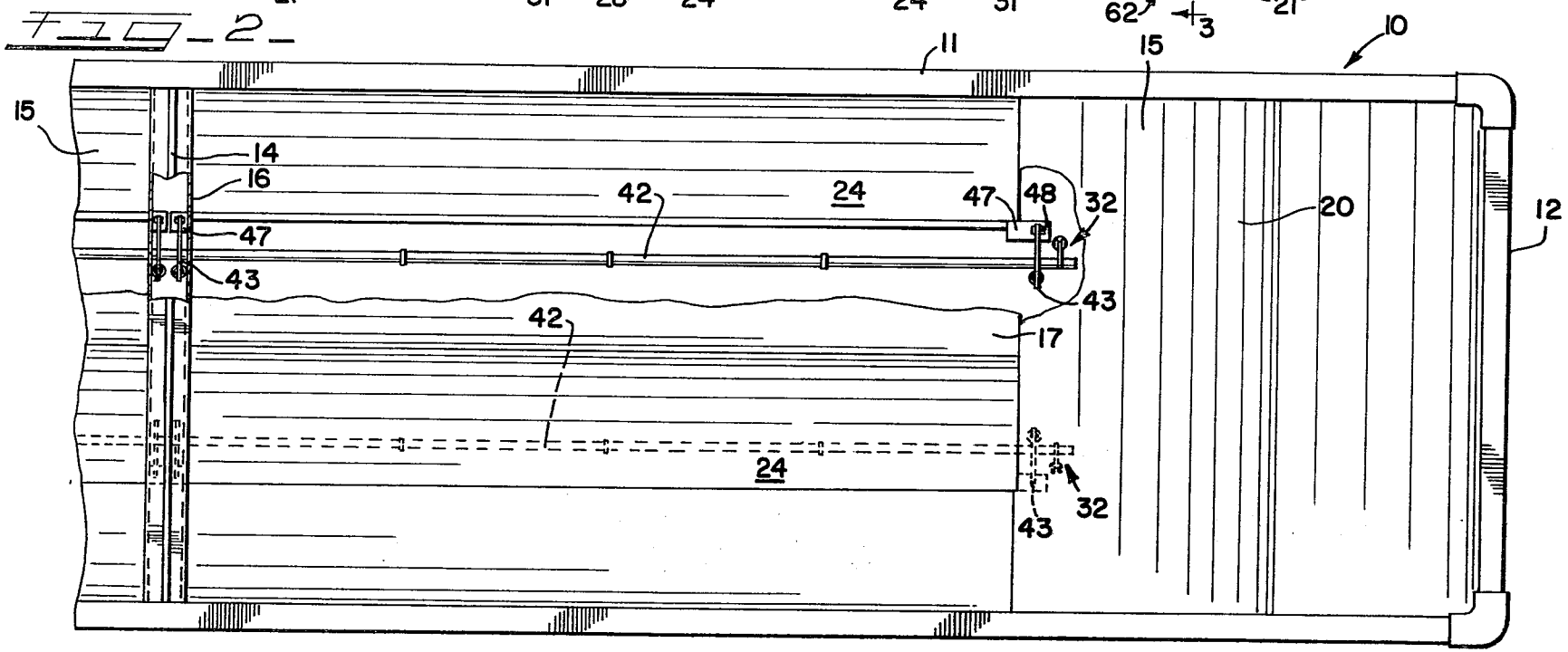
FIG. 2 is a plan view of an end portion of the railway car shown in FIG. 1 showing portions of the floor broken away to disclose a door actuating mechanism.

As best shown in FIG. 3 a door locking mechanism 32 is provided for each of the doors and includes a plunger 33 having at its lower end fixed laterally spaced straps 34 which support for rotation cam followers or rollers 35. The plunger 23 is reciprocable within a tubular guide 36 in turn fixedly supported on a bracket 37, each of said brackets for oppositely disposed doors being supported on the lower flanges 19' of the cross support 19. The upper ends of the plunger 33 are connected to a pair of links 38 by means of pivot members 39. The links 38 in turn are connected by pivot means 40 to an arm 41 which extends transversely and is fixedly mounted to a longitudinally actuating rod or tube 42. As best shown in FIGS. 1 and 2 the tubes 42 extend substantially the length of the doors for actuating the door of each hopper between closed and open positions.

The bell crank latch lever 43 is fixedly connected to longitudinal actuating rods 42 at opposite ends of each door and includes a rear end portion 44 and a keeper engaging front hook portion 45. The end portion 44 of each latch lever is urged into a locking position by means of springs 46 supported on the cross supports 19. Each of the doors as best shown in FIGS. 2 and 3 is provided at opposite ends thereof with outwardly projecting keeper plates 47 having keeper openings 48.

Figure 4:
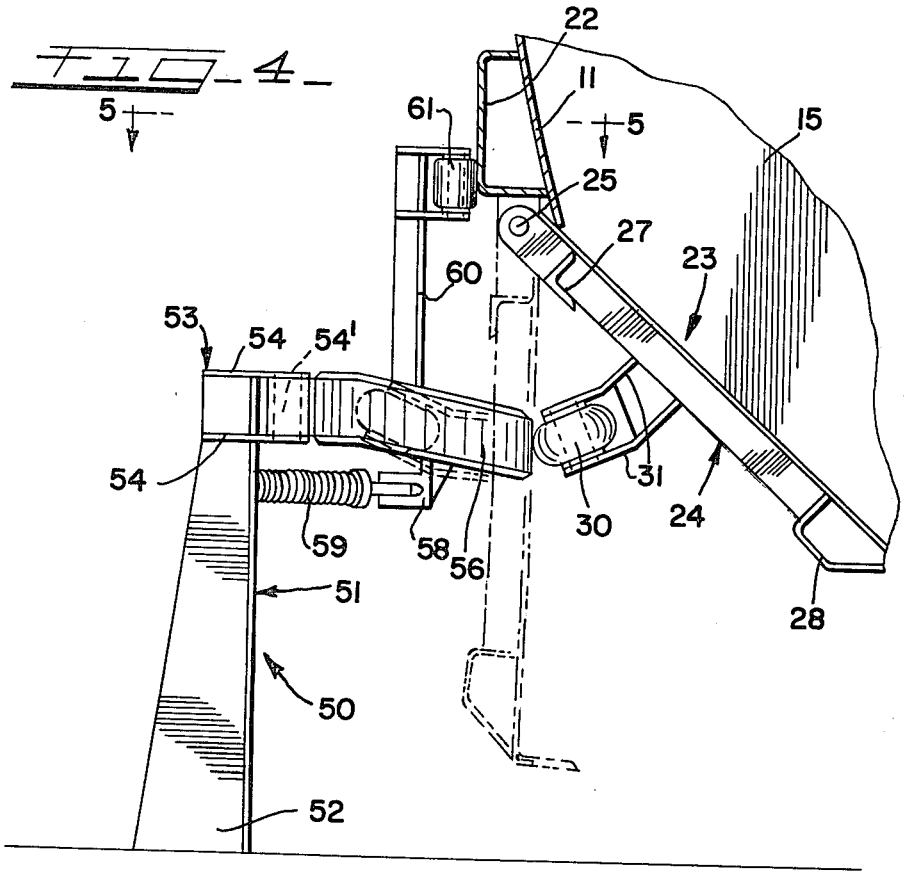
FIG. 4 is a side elevational view showing portions of an adjacent railway car in section, and a ground located closure camming mechanism.
Figure 5:
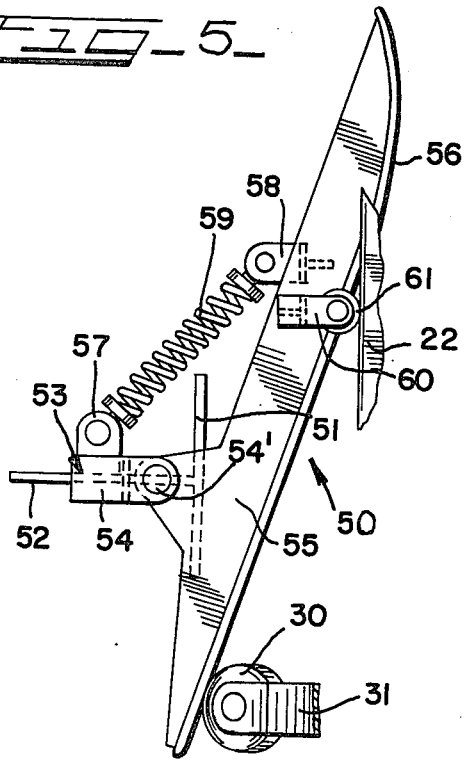
FIG. 5 is a cross-sectional view taken substantially along the line 5—5 of FIG. 4.

A trackside door closing mechanism 50 is best disclosed in FIG. 5. The mechanism 50 includes a vertical pedestal 51 having a laterally extending upright support plate 52. A pivot bracket generally designated at 53 includes vertically spaced plates 54 pivotally supporting a pivot member 54' which is connected to a cam 55. The cam 55 includes an outer cam surface 56. An ear 57 supported on the upright plate 52 has connected thereto a spring 59 which at its other end is connected to a second ear 58 being supported on and projecting downwardly from the cam 55. A drive bracket 60 connected to the cam 55 projects upwardly with respect thereto and has connected at its upper end a guide roller 61 which is adapted to engage the side sill 22 of the car as best shown in FIG. 4.

Referring particularly to FIGS. 3 and 6 a ground located wheel trip mechanism 62 is positioned adjacent to the rail of a track 63. The mechanism 62 includes a bracket 64 which is adapted to be fixedly supported on the ground between the tracks. Each bracket 64 includes pivot pin means 65 to which a bell crank shaped arm 66 is connected. The arm 66 at one end is provided with a wheel engaging lever portion 67 as best shown in FIG. 6. The cam 68 is also securely connected to the sides of the arm 66 and is adapted to be engaged by the cam follower wheel 35 provided at the bottom of the plunger 33.

OPERATION

As the railway car 10 approaches its destination it may travel upon the tracks 63 which are supported on a trestle through which the load within the car is to be dumped. As it reaches the dumping area the wheels engage the wheel engaging portion 67 of the wheel trip mechanism 62 thereby pivoting the same which forces the plungers 33 upwardly thereby pivoting the same against the action of the spring and whereupon the hook-shaped latch portions 45 are disengaged from the openings 48 of the keeper plates 47. This position is shown in the broken lines in FIG. 3 and thereupon the doors will open and the load is discharged downwardly to one side of the railway car into the space provided. The car now continues movement toward the closing cam mechanism 50 and as it moves along the tracks 63, the open doors with their rollers or followers 30 engage the cam surfaces 56 as best shown in FIG. 5. Initial engagement of the rollers 30 provides for pivotable movement of the cam 55 about the pivot 54' tensioning the spring 59 whereupon the roller 61 now engages the side of the side sill 22 in rolling relation as the car moves along. By virtue of the position of the cam surfaces 56 the doors 30 are now swung inwardly into their latched position the springs 46 being in the solid line position shown in FIG. 3 whereupon as the doors swing inwardly they are automatically locked into engagement with the keeper engaging portions of each of the latch levers. Thus the doors are now again securely locked in position for subsequent loading of the car.

What is claimed is:

1. In a railway hopper car riding on wheels and having a hopper structure including downwardly and outwardly diverging slope sheets, outer side walls defining with said slope sheets discharge openings, and doors hingedly connected to said outer walls movable downwardly and outwardly from closed to open positions, the improvement of a door locking mechanism for each door comprising, a support on said hopper, a plunger reciprocally connected to said support, wheel trip actuating means movably supported on the ground adjacent to a railway track for actuation upon engagement with a car wheel and having cam means adapted to contact and move said plunger, a latch mechanism movably supported on said hopper car and including an arm having a hook portion, a keeper means associated with said door and engageable with said hook portion during the closed position of said door, said plunger being movable in one direction upon engagement with said wheel trip actuating means to engage and move said hook portion out of engagement with said keeper means whereby said door is moved to an open position.

2. The railway hopper car in accordance with claim 1, and:

biasing means urging said arm to the engaged position.

3. The railway hopper car in accordance with claim 1, and:

said arm comprising a bell crank pivotally connected to said hopper, and a spring supported on said hopper for biasing said bell crank to a closed position.

4. The railway hopper car in accordance with claim 3, and:

including a link pivotally connected to said plunger and to said bell crank.

5. The railway hopper car in accordance with claim 3, and:

said keeper means projecting outwardly with respect to said hopper door and including a keeper opening.

6. The railway hopper car in accordance with claim 5, and:

said keeper means being substantially parallel to said adjacent slope sheet when said hopper door is in the closed position.

7. The railway hopper car in accordance with claim 6, and:

said plunger having at its lower end cam follower means, and said cam means on said wheel trip actuating means engageable with said cam follower during movement of said actuating means.

8. The railway hopper car in accordance with claim 1, and:

including door closure means comprising a support positioned on the ground adjacent to said track, a second arm hingedly connected to said support for swinging movement in a direction toward and away from a car traveling on said track;

said second arm having an inner vertical cam surface, and means on said door adapted to engage said cam surface, said cam surface being adapted to swing said door to its closed position.

9. The railway hopper car in accordance with claim 8, and:

including means connecting said second arm and said support for urging said second arm toward said closed position.

10. The railway hopper car in accordance with claim 9, and:

said support including means hingedly supporting said second arm intermediate the ends of said cam for hinging movement about a vertical axis.

11. The railway hopper car in accordance with claim 10, and:

including reaction means on said second arm for engaging a surface of the hopper car for limiting hinging movement of said second arm.

12. The railway hopper car in accordance with claim 11, and:

said reaction means including roller means, and said hopper car having a side sill engaged by said roller means.

* * * * *